United States Patent [19]

Seireg et al.

[11] 4,289,126

[45] Sep. 15, 1981

[54] PRESSURE REGULATOR FOR BREATHING APPARATUS

[75] Inventors: Ali A. Seireg; Amr M. S. Baz, both of Madison, Wis.

[73] Assignee: Wisconsin Alumni Research Foundation, Madison, Wis.

[21] Appl. No.: 35,317

[22] Filed: May 2, 1979

[51] Int. Cl.[3] ..... B63C 11/00; A62B 7/04

[52] U.S. Cl. ..... 128/204.24; 128/204.26; 128/205.19; 137/484.2; 137/804; 137/625.2; 137/596

[58] Field of Search ..... 128/204.24, 204.25, 128/204.26, 204.27, 205.24, 204.29, 205.19; 137/484.2, 625.2, 596, 102, 804, 805

[56] References Cited

U.S. PATENT DOCUMENTS

| | | | |
|---|---|---|---|
| 3,234,932 | 2/1966 | Bird et al. | 128/204.25 |
| 3,285,261 | 11/1966 | Chaney | 128/204.26 X |
| 3,368,555 | 2/1968 | Beasley | 128/204.24 |
| 3,628,532 | 12/1971 | Magrath | 128/205.24 X |
| 3,859,995 | 1/1975 | Colston | 128/204.25 |
| 4,041,978 | 8/1977 | Leemann | 137/494 |
| 4,095,592 | 6/1978 | Delphia | 128/204.26 |
| 4,106,504 | 8/1978 | York | 128/204.24 |
| 4,182,323 | 1/1980 | Pedersen | 128/204.25 |

OTHER PUBLICATIONS

Northeast Fluidics Sensing and Interface Valves and Components, published by Clippard Instrument Laboratory, Inc., 1978, pp. 1, 2, 16 and 17.

*Primary Examiner*—Henry J. Recla

*Attorney, Agent, or Firm*—Isaksen, Lathrop, Esch, Hart & Clark

[57] ABSTRACT

A pressure regulator for breathing apparatus which utilizes a low pressure control signal to control the inhalation of gases through the regulator. A first low pressure control valve is actuated by the diver's inhalation effort to provide a pressure signal which is used to control a main valve which supplies the breathing mixture input to the diver. Separate exhalation exhaust assist may be provided which utilizes energy from the air tank to help eject the diver's exhaust gases from the regulator.

15 Claims, 3 Drawing Figures

PRESSURE REGULATOR FOR BREATHING APPARATUS

The Government has rights in this invention pursuant to Grants Nos. 04-6-158-44103 and 04-7-158-44097 awarded by the U.S. Department of Commerce.

BACKGROUND OF THE INVENTION

1. Field of the Invention

This invention pertains generally to the field of pressure regulators for breathing apparatus such as that used by underwater divers.

2. Description of the Prior Art

Pressure regulators are a necessary component of any underwater breathing apparatus, providing the necessary reduction of breathing gases from the high pressure of the tank to a lower pressure which is somewhat above ambient water pressure. In addition, the regulator must provide a means for controlling the flow of breathing mixture in accordance with the diver's demands. A first stage regulator at the tank is usually used to reduce the supply pressure to a substantially constant pressure above ambient, typically 130 to 150 psig. A second or final stage regulator receives the reduced pressure breathing mixture and meters it to the diver in accordance with his demands.

A common type of final stage pressure regulator employs a breathing chamber from which the diver draws breathing mixture and from which the diver's breath is exhausted. A flexible diaphragm is mounted across the breathing chamber and separates the gas in the chamber from ambient water. The diaphragm is drawn in as the diver inhales and is pushed out as the diver exhales. These movements of the diaphragm are transmitted by a lever to a valve connected to the source of breathing mixture such that inward movements of the diaphragm open the valve to allow breathing mixture to flow to the diver, whereas cessation of inhalation by the diver causes the diaphragm to move back out, thereby allowing a spring to close the valve and cut off the flow of breathing mixture to the diver. As the diver exhales, the contraction of his lungs increases the pressure in the breathing chamber and causes an exhalation port check valve to open to discharge the used breathing gases into the ambient water.

In regulators of the type just mentioned, substantial effort is required of the diver as he breathes to produce enough vacuum in the diaphragm chamber to force open the air supply valve on the intake stroke. In addition, the diver must force the gases from his lungs through the breathing chamber and the exhaust port, which requires a substantial effort on his part and contributes to diver fatigue.

Systems have been developed which provide some additional assistance during inhalation, for example by utilizing a pilot valve operated by the diaphragm which direct a portion of the breathing mixture to operate the main breathing supply valve. Such systems have a disadvantage in that they utilize the relatively high pressure breathing mixture input to control operation of the main valve, which renders the system potentially unstable, particularly at high breathing rates.

SUMMARY OF THE INVENTION

The pressure regulator of the invention provides a closely controlled supply of breathing mixture to the diver while requiring the diver to exert only a small vacuum draw on the breathing apparatus in order to initiate supply of breathing mixture to his lungs, even up to the maximum breathing rates. The regulator provides such control without additional mechanical linkages and other potential sources of instability. In a preferred embodiment, a small portion of the storage tank gases are also utilized to assist the exhalation of used breathing gas from the diver's lungs to minimize still further the effort required of the diver on both the inhalation and exhalation stroke.

The apparatus preferably includes a regulator case the interior cavity of which is divided by a flexible diaphragm into a breathing chamber and an ambient water chamber. A lever transmits the inward motion of the diaphragm on the diver's intake stroke to a low pressure control valve which is supplied with breathing mixture at a pressure substantially less than the breathing mixture input pressure from a first stage regulator. When the control pressure signal is passed through the control valve, it is directed through a fluidic control mechanism to open the main supply valve which controls the flow of breathing mixture to the diver. A preferred embodiment of the inhalation system of the invention utilizes a diaphragm operated control valve which provides a low pressure control signal. The low pressure signal is provided to a first pneumatic control input on the main supply valve to directly switch the valve from a closed position cutting off the supply of breathing mixture to an open position allowing the breathing mixture to flow therethrough. The breathing mixture thereafter flows through a bistable fluidic amplifier which allows continuous passage of the breathing mixture through a first branch passageway to the diver's breathing port as long as less than ambient pressures are maintained in the breathing chamber. When the diver ceases inhaling, the continued flow of breathing mixture causes pressure within the breathing chamber to build above ambient. The overpressure is transmitted to the bistable fluidic amplifier to cause the same to immediately switch the flow of breathing mixture to a second branch passageway in the fluidic amplifier. The second branch passageway directs the breathing mixture stream back to a second control input on the main supply valve to switch the same to a closed position cutting off the further flow of breathing mixture. The main supply valve is preferably balanced and spring biased to a neutral position so that only a small pressure signal from the control valve is required to actuate it. Thus, the control valve can be made highly sensitive and easily opened by the actions of the diaphragm during the initial air intake of the diver.

Exhaust assist may be provided at the exhaust port by utilizing a portion of the energy stored in the breathing mixture to help to draw the used breathing gases out of the regulator. In a preferred embodiment, a vortex-venturi is provided at the exhaust port of the regulator.

A separate exhalation assist valve is provided within the regulator having a lever actuated by outward movement of the main diaphragm as pressure within the breathing chamber increases upon exhalation. The exhalation assist valve thereafter directly supplies breathing mixture under pressure to the vortex-venturi exhaust port.

The additional assist provided at the exhaust port of the regulator substantially reduces the effort required of the diver in exhaling gases into the ambient water. This effort can be substantial, since the air exhausted from the diver's lungs must pass through the passages and restrictions within the regulator itself before being exhausted to the ambient water, thereby creating a back pressure which the diver must use muscular force to overcome. Other similar pressure assisted output devices which utilize pressure energy from the pressurized breathing mixture may be provided in place of the vortex-venturi.

It is thus a primary object of the present invention to require minimum diver's effort to control the main breathing mixture supply, and to use fluidic feedback to match the flow of breathing mixture from the tank with the diver's demand and minimize potential instabilities. The fluidic components of the regulator automatically develop positive pressures to control the main supply valve as soon as inhalation ceases. During exhalation, slight over pressures in the breathing chamber will activate the exhalation assist valve which provides adequate suction to help draw the used breathing mixture from the diver's lungs and out of the regulator.

Further objects, features and advantages of the invention will be apparent from the following detailed description taken in conjunction with the accompanying drawings showing preferred embodiments of the invention.

DESCRIPTION OF THE PREFERRED EMBODIMENTS

Figure 1:
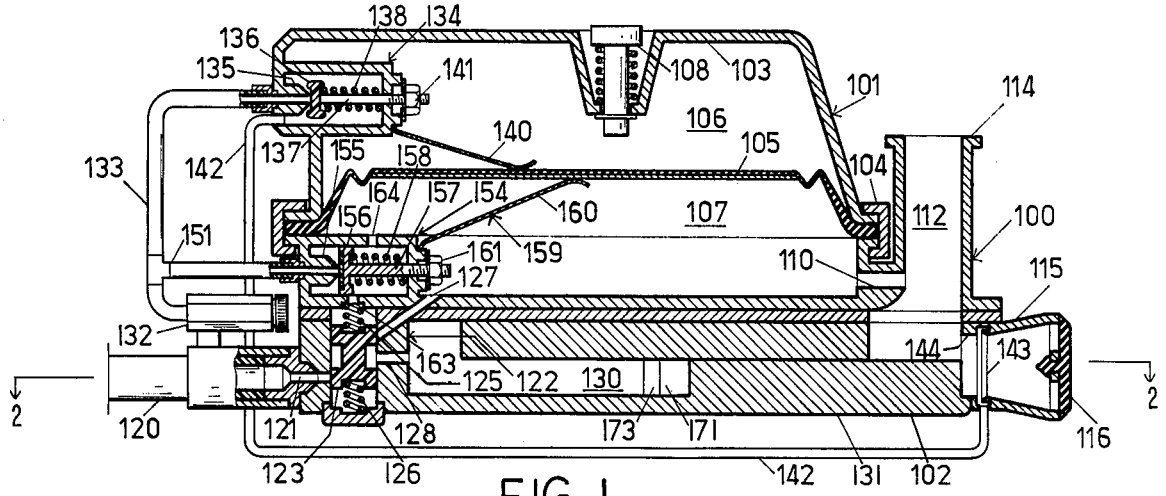
FIG. 1 is a cross-sectional view of a regulator having inhalation and exhalation assist.

An embodiment of the regulator of the invention which has both inhalation and exhaust assist is shown generally at 100 in the cross-sectional view of FIG. 1. The regulating apparatus 100 includes a case 101 having a base portion 102, and a dome shaped cover 103 which fits on the base and is held thereon by a retaining ring 104. A flexible diaphragm 105 is secured between the cover 103 and the base 102 to divide the area between the cover and the base into a water chamber 106 and a breathing chamber 107. A pressure relief button 108 is mounted on the top of the cover in position to contact the diaphragm and provide purging of the breathing chamber.

The breathing chamber 107 is in communication through a channel 110 with the bore 112 of the diver's breathing port 114. The bore 112 is also directly in communication with the exhaust port 115 which is normally closed by a plastic check valve 116.

Breathing mixture is supplied from a regulator at the tank (not shown) at approximately 130 to 150 psig through a supply hose 120 which leads into the input port 121 of the main breathing mixture supply valve 122. The valve 122 is a three-way three position valve having a central spool 123 slidable back and forth within the bore of the valve and biased to a central position by springs 125 and 126. A relief port 127 provides communication between the bore of the valve 122 and the breathing chamber 107. An output port 128 leads from the bore of the valve 122 to an output passageway 130 in the base which extends through a bistable fluidic amplifier 131 to the bore 112 of the diver's breathing port 114 and the output port 115.

Breathing mixture under pressure is tapped off of the supply line 120 through an adjustable pressure regulator 132 which reduces the pressure to approximately 20 psi above ambient, and thence through a spur line 133 to an exhalation assist valve 134 mounted in the water chamber 106. The valve 134 has a valve seat 135 having a bore in communication with the spur line 133, a closure member 136 mounted to a valve stem 137, and a spring 138 normally biasing the closure member 136 into position to close the flow of breathing mixture through the valve. A control lever 140 is mounted at one end between the body of the valve 134 and a washer and nut 141 threaded to the end of the valve stem 137. The lever 140 extends at its other end to contact with the outer side of the diaphragm 105 so as to be moved thereby when the diaphragm moves outwardly as the diver is exhaling, thereby responding to pressure in the breathing chamber to switch the exhalation valve to its open position. When opened, the valve 134 directs breathing mixture through a supply line 142 to passageways 143 formed in the throat 144 of vortex-venturi shaped walls forming the inner surfaces of the output port 115.

The breathing mixture from the regulator 132 is also tapped out through a branch line 151 to a control valve 154 mounted in the breathing chamber 107. The valve 154 has a valve seat 155, the bore of which communicates with the supply line 151, a valve closure member 156 mounted on the end of a stem 157, and a spring 158 which normally biases the closure member 156 to a closed position shutting off the flow through the bore of the valve seat 155. A valve operating linkage 159 includes a control lever 160 mounted at one end between the body of the valve 154 and a threaded retaining nut and washer 161. The other end of the control lever 160 extends up to contact with the diaphragm 105 when in its normal undeflected position wherein the breathing chamber is at ambient pressure. When the valve 154 is in its normal spring closed position, it provides communication between a first control input port 163 of the main air supply valve 122 and a channel 164 which leads to the breathing chamber 107. Thus, when the valve 154 is in its closed position, the pressure in the breathing chamber 107 is transmitted through the channel 164 and the port 163 to the interior bore of the main supply valve 122 on one side of the central spool 123. The central bore of the valve on the other side of the spool 123 is in communication with a second control input port passageway 166 (not shown in FIG. 1) formed in the base 101.

Figure 2:
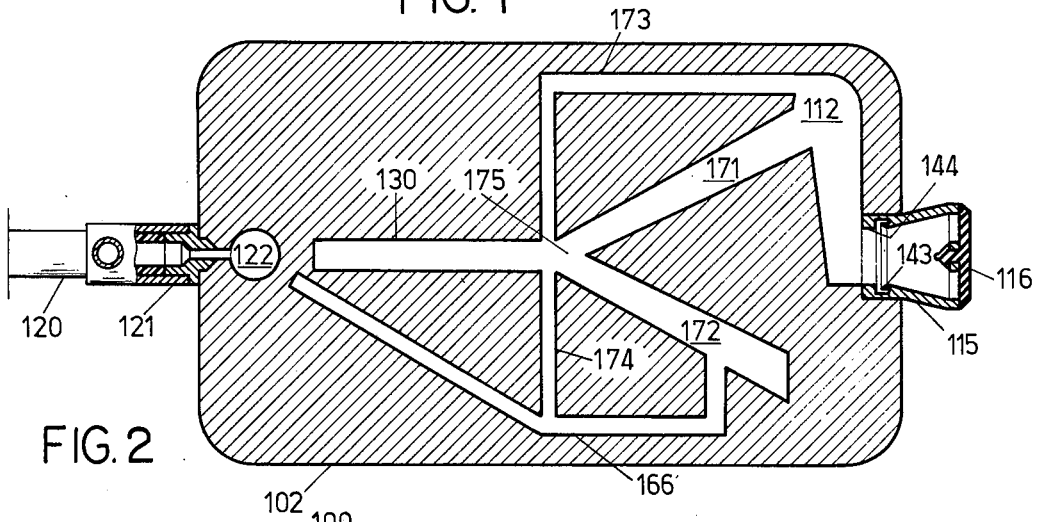
FIG. 2 is a cross-sectional view of the apparatus of FIG. 1 taken along the line 2—2 of FIG. 1.

A cross-section of the base taken along the lines 2—2 of FIG. 1 is shown in FIG. 2. Shown therein are the fluidic passageways formed within the base for accomplishing the required switching logic. The fluidic logic circuit shown in FIG. 2 provides a bistable amplifier configuration, directing flow from the valve 122 through the output passageway 130 to either a first branch passageway 171 or a second branch passageway 172, depending on the relative pressures present at control passageways 173 and 174, which intersect the aforementioned branch passageways at a junction point 175. When the breathing mixture input is deflected into the first branch passageway 171, it is directed into the bore 112 of the breathing port 114. Flow deflected into the second branch passageway 172 is directed through the feedback passageway 166 back to the second control input of the main supply valve 122.

Figure 3:
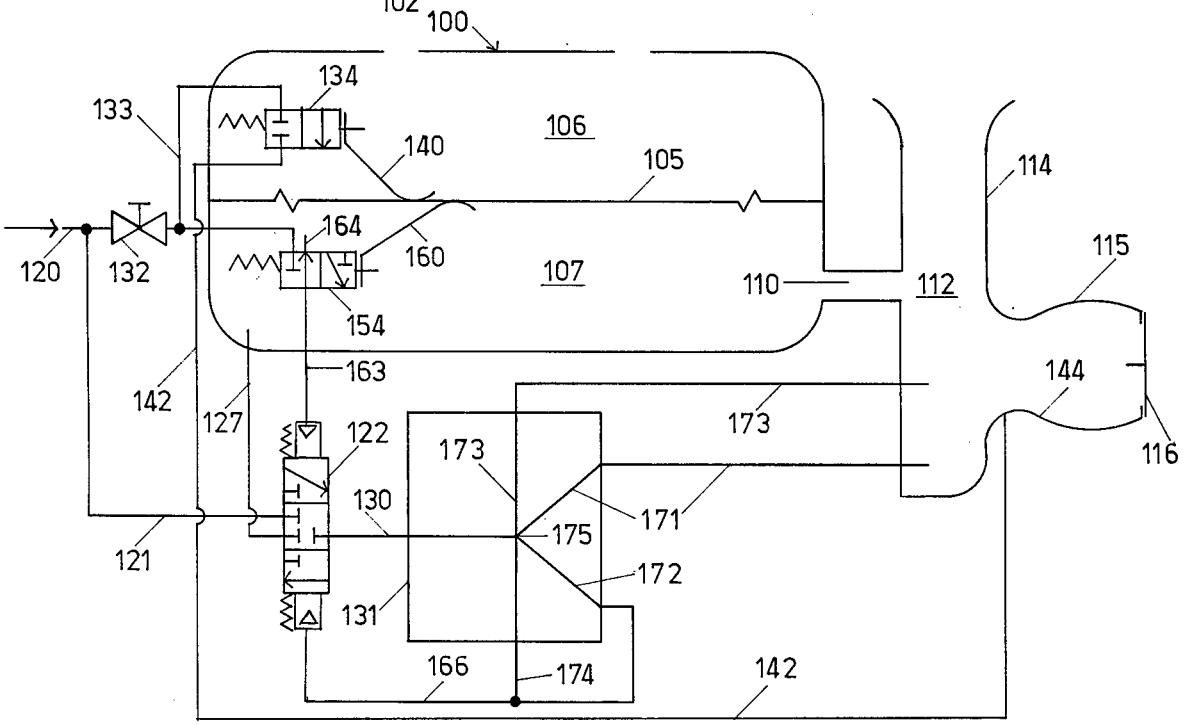
FIG. 3 is a simplified schematic view showing the fluidic components of the regulator of FIG. 1.

The operations of the regulator 100 are best shown with reference to the view of FIG. 3, in which the fluidic components of the apparatus are shown in schematic form. Inhalation by the diver creates an underpressure in the bore 112 of the diver's breathing port 114 which is transmitted through the channel 110 to the breathing chamber 107. The underpressure in the breathing chamber draws in the diaphragm 105 which causes the lever 160 to switch the control valve 154 open to direct control pressure breathing mixture from the line 151 to the channel 163. The control pressure signal transmitted through the channel 163 causes the spool 123 to move downwardly, opening the valve 122 to direct breathing mixture from the input port 121 to the output passageway 130. Because an underpressure is developed in the breathing chamber and in the breathing port bore 112, the control passageway 173 will have the underpressure applied thereto, which will deflect the breathing mixture to the first branch passageway and thence to the bore of the breathing port.

Breathing mixture will continue to flow into the bore 112 as long as the diver continues to inhale. However, when the diver stops inhaling, continued flow of breathing mixture will cause pressure to build up above ambient in the bore and breathing chamber 107 which will be transmitted through the control passageway 173 to the junction 175. The overpressure in the control passageway 173 will cause the breathing mixture flow to be switched over to the second branch passageway 172 and thence to the feedback channel 166 and the second control input of the main supply valve 122. The spool 123 is thus driven upwardly since the pressure in the control input passage 166 is much greater than that in the passageway 163. The motion of the spool terminates in a "closed" position in which the flow of breathing mixture from the line 121 is blocked, and in which communication is provided between the passageway 130 and the exhaust channel 127 to allow release of pressure within the passageway 130. Release of this pressure consequently releases the pressure in the feedback passageway 166 to allow the spool to be spring biased back to its initial neutral position in which all inputs and the output are blocked. Thus, it is seen that the action of the bistable fluidic amplifier 131 provides rapid and effortless shut-off of the main breathing mixture supply valve by fluidic control without any additional effort on the part of the diver.

As the diver starts to exhale, pressure builds up within the breathing port bore 112 which is transmitted through the passageway 110 to the breathing chamber 107. This overpressure causes the diaphragm 105 to be moved outwardly. The movement of the diaphragm is transmitted through the control lever 140 to switch the exhaust valve 134 to its open position wherein breathing mixture from the line 132 is directed to the connecting line 142, and thence to the throat 144 of the vortex-venturi shaped exhaust port 115. The flow of high pressure gases out of these passageways increases the vacuum draw of the venturi to aid the diver in exhausting the gases from his lungs.

It is apparent that other fluidic control elements could be substituted in the aforementioned embodiment of the invention without departing from the spirit and scope of the invention. For example, an impact modulator amplifier or a turbulence amplifier could be substituted for the bistable fluidic amplifier 131 shown in FIG. 3 without substantially affecting the performance of the invention. Both of these devices function such that differences in control pressures on control lines (equivalent to control passageways 173 and 174) determine the switching of breathing mixture under pressure to either of two output lines (equivalent to the branch passageways 171 and 172). The pressure on the output lines can be provided to the control inputs of the main supply valve to switch the same when pressure in the breathing chamber or exhaust port exceeds ambient. The control logic with any of these devices is thus substantially the same.

Similarily, various other types of exhalation assist devices may be utilized in place of the vortex-venturi exhaust port described above. For example, high pressure breathing mixture can be switched as described above and directed to the throat of the exhaust port with an ejector or eductor type passageway orifice being used to enhance the draw of used breathing mixture out of the breathing chamber. A Coanda throat device may also be utilized for this purpose, as well as any similar device wherein a portion of the breathing mixture under pressure is controllably diverted to the exhaust port to develop additional draw at the port to aid in withdrawal of breathing gases from the regulator.

It is understood that the invention is not confined to the particular construction and arrangement of parts herein illustrated and described, but embraces all such modified forms thereof as come within the scope of the following claims.

We claim:

1. A pressure regulator for use with breathing apparatus which provides breathing mixture at a substantially constant pressure above ambient and which also provides breathing mixture at a substantially lower control pressure, comprising:

(a) a case having interior walls defining a breathing chamber therein, and a breathing port and an exhaust port in said case both of which are in communication with said breathing chamber;

(b) a pneumatically operable main supply valve communicating with said breathing port and adapted to receive breathing mixture and switchable to open to supply breathing mixture to said breathing port;

(c) a low pressure control valve adapted to receive control pressure breathing mixture at a pressure substantially less than that supplied to said main supply valve, said control valve being biased closed and switchable to open to supply a low pressure breathing mixture control signal;

(d) means responsive to the pressure in said breathing chamber for opening said control valve when the pressure in said breathing chamber drops below ambient;

(e) fluidic control means responsive to the control pressure output signal from said control valve for providing a pneumatic output signal to switch said main supply valve to its open position providing breathing mixture to said breathing port, said fluidic control means also responsive to pressure in said breathing chamber for switching said main supply valve to its closed position when the pressure in said breathing chamber exceeds ambient pressure;

(f) passageways formed in the walls of said exhaust port which are adapted to direct breathing mixture flowing therethrough outwardly to provide power assist to draw used breathing mixture therethrough;

(g) an exhalation assist valve communicating with said exhaust port passageway and adapted to receive breathing mixture under pressure, including a valve body formed in said case and having a valve opening formed therein for receiving breathing mixture under pressure which is directed through said valve body to said passageways in said exhaust port, and a valve closure member biased by a spring to close off said valve opening and switchable to open to supply breathing mixture to said passageways in said exhaust port; and (h) means responsive to pressure in said breathing chamber for switching said exhalation assist valve open when the pressure in said breathing chamber is above ambient, whereby exhalation by the diver will increase the pressure in said breathing chamber above ambient and will result in breathing mixture under pressure being directed to said exhaust port to assist the exhalation of the used breathing mixture therefrom, said means responsive to pressure including a flexible diaphragm mounted across a cavity formed in said case which is in communication with said breathing chamber, said flexible diaphragm being mounted to said valve closure member of said exhalation assist valve such that pressure above ambient in said breathing chamber will cause said flexible diaphragm to force said valve closure member away from said valve opening against the force of said spring biasing the same closed.

2. The regulator of claim 1 wherein said means responsive to the pressure in said breathing chamber comprises a diaphragm secured within said case and having a surface thereof facing said breathing chamber, and a mechanical linkage extending between said diaphragm and said control valve which is operable to open said control valve when said diaphragm is drawn inwardly into said breathing chamber, and wherein said pneumatically operable main supply valve has pneumatic control inputs adapted to receive control pressure signals to switch the same between the open and closed positions of the valve, and wherein said fluidic control means supplies the low pressure control signals from said low pressure control valve to one of the control inputs of said main supply valve to selectively switch said main supply valve to its open position, and wherein said fluidic control means further includes bistable fluidic means, receiving breathing mixture under pressure and responsive to pressure in said breathing chamber, for normally maintaining said main supply valve in its open position when the pressure in said breathing chamber is at or below ambient, and for providing a pressure signal to the other of the control inputs of said main supply valve when the pressure in said breathing chamber is above ambient to switch said main supply valve to a closed position blocking the flow of breathing mixture.

3. The regulator of claim 2 further comprising:

(a) passageways formed in the walls of said exhaust port which are adapted to direct breathing mixture flowing therethrough outwardly to provide power assist to draw used breathing mixture therethrough;

(b) an exhalation assist valve communicating with said exhaust port passsageways and adapted to receive breathing mixture under pressure, said exhalation assist valve being biased closed and switchable to open to supply breathing mixture to said passageways in said exhaust port;

(c) means responsive to pressure in said breathing chamber for switching said exhalation assist valve open when the pressure in said breathing chamber is above ambient, whereby exhalation by the diver will increase the pressure in the breathing chamber above ambient and result in breathing mixture under pressure being directed to said exhaust port to assist exhalation.

4. The regulator of claim 3 wherein said means responsive to pressure for switching said exhalation assist valve open comprises a mechanical linkage extending between said flexible diaphragm and said exhalation assist valve which is operable to open said exhalation assist valve when said diaphragm is pushed outwardly from said breathing chamber.

5. The regulator of claim 3 wherein the walls of said exhaust port define a venturi shape and wherein said passageways in said exhaust port direct breathing mixture outwardly from the throat of the venturi shaped exhaust port walls.

6. A pressure regulator for use with breathing apparatus which provides breathing mixture at a substantially constant pressure above ambient and which also provides breathing mixture at a substantially lower control pressure, comprising:

(a) a case having interior walls defining a cavity therein, a flexible diaphragm secured to said case and dividing the cavity into a breathing chamber and a water chamber which is in communication with ambient water, and a breathing port and an exhaust port in said case both of which are in communication with said breathing chamber;

(b) a main breathing mixture supply valve communicating with said breathing port and adapted to receive breathing mixture under pressure, said valve being switchable from a closed position blocking breathing mixture to an open position supplying breathing mixture to said breathing port and having pneumatic control inputs adapted to receive control pressure signals to switch the same between the open and closed positions of the valve;

(c) a low pressure control valve adapted to receive control pressure breathing mixture at a pressure substantially less than that supplied to said main supply valve and communicating with a control input of said main supply valve which, when supplied with a pressure signal, causes said main supply valve to switch to its open position, said control valve being biased closed and switchable to open to supply a low pressure breathing mixture control signal to the control input of said main supply valve to switch said main supply valve to its open position, and a mechanical linkage extending between said diaphragm and said control valve which is operable to open said control valve when said diaphragm is drawn inwardly into said breathing chamber; and (d) bistable fluidic means receiving breathing mixture under pressure and responsive to pressure in said breathing chamber for normally maintaining said main supply valve in its open position when the pressure in said breathing chamber is at or below ambient, and for providing a pressure signal to the other of the inputs of said main supply valve when the pressure in said breathing chamber is above ambient to switch said main supply valve to a closed position blocking the flow of breathing mixture.

7. The regulator of claim 1 or 6 including a control pressure regulator connected to supply breathing mixture to said control valve at a pressure above ambient which is substantially lower than the pressure of the breathing mixture provided to said main supply valve.

8. The regulator of claim 6 or 2 wherein said control valve comprises a valve seat having an interior bore in communication with a source of breathing mixture at a pressure substantially lower than that supplied to said main supply valve, a valve closure member mounted on the end of a valve stem and a spring biasing said closure member between a valve body into contact with said valve seat to normally close off the same, and wherein said mechanical linkage comprises a lever extending from attachment to the valve stem at one end up to contact said diaphragm at its other end when said diaphragm is in its normal position wherein the pressure in said breathing chamber is substantially at ambient, and wherein inward movement of said diaphragm causes said lever to be depressed downwardly to draw said valve stem outwardly to open said control valve to allow control pressure breathing mixture therethrough.

9. The regulator of claim 6 further comprising:

(a) passageways formed in the walls of said exhaust port which are adapted to direct breathing mixture flowing therethrough outwardly to provide power asssist to draw used breathing mixture therethrough;

(b) an exhalation assist valve communicating with said exhaust port passageways and adapted to receive breathing mixture under pressure, said exhalation assist valve being biased closed and switchable to open to supply breathing mixture to said passageways in said exhaust port; and (c) means responsive to pressure in said breathing chamber for switching said exhalation assist valve open when the pressure in said breathing chamber is above ambient, whereby exhalation by the diver will increase the pressure in said breathing chamber above ambient and will result in breathing mixture under pressure being directed to said exhaust port to assist the exhalation of the used breathing mixture therefrom.

10. The regulator of claim 9 wherein said exhalation assist valve includes a valve body formed in said case and having a valve opening formed therein for receiving breathing mixture under pressure which is directed through said valve body to said passageways in said exhaust port, and a valve closure member biased by a spring to close off said valve opening, and wherein said means responsive to pressure in said breathing chamber comprises a flexible diaphragm mounted across a cavity formed in said case which is in communication with said breathing chamber, said flexible diaphragm being mounted to said valve closure member of said exhalation assist valve such that pressure above ambient in said breathing chamber will cause said flexible diaphragm to force said valve closure member away from said valve opening against the force of said spring biasing the same closed.

11. The regulator of claim 6 or 2 wherein said bistable fluidic means comprises a bistable fluidic amplifier receiving the breathing mixture output from said main supply valve and controllably directing the flow of breathing mixture to first and second branch passageways, the first branch passageway directing breathing mixture to said breathing port and said second branch passageway directing breathing mixture to the other of said control inputs of said main supply valve which, when supplied with breathing mixture under pressure, drives said main supply valve to a position blocking the flow of breathing mixture therethrough, said bistable amplifier having a first control passageway in communication with said breathing chamber and said breathing port and a second passageway in communication with said second branch, said control passageways being arranged such that lower pressure on the first control passageway than on the second control passageway will direct breathing mixture to said first branch, and lower pressure on said second passageway than on said first passageway will direct breathing mixture to said second branch, wherein when said diver is inhaling the pressure in said breathing chamber and breathing port will be lower ambient and said breathing mixture will be directed to said first branch and into said breathing port, and wherein when the pressure in said breathing chamber and breathing port rises above ambient, the pressure in said first control passageway will be greater than that in said second control passageway and the flow of breathing mixture will be directed to said second branch and thence to the other control input of said main supply valve to cause said main supply valve to be switched to its closed position.

12. A pressure regulator for use with breathing apparatus which provides breathing mixture at a substantially constant pressure above ambient, comprising:

(a) a case having interior walls defining at least a breathing chamber therein, and a breathing port and an exhaust port in said case both of which are in communication with said breathing chamber;

(b) a main breathing mixture supply valve communicating with said breathing port and adapted to receive breathing mixture under pressure, said valve being biased closed and switchable to open to supply breathing mixture to said breathing port;

(c) means responsive to pressure in said breathing chamber for switching said main supply valve to its open positions when pressure in said breathing chamber is below ambient;

(d) passageways formed in the exhaust port walls which are adapted to direct breathing mixture flowing therethrough outwardly to provide power assist to draw used breathing mixture therethrough; (e) an exhalation assist valve communicating with said exhaust port passageways and adapted to receive breathing mixture under pressure, said exhalation assist valve being biased closed and switchable to open to supply breathing mixture to said passageways in said exhaust port, said exhalation assist valve including a valve body formed in said case and having a valve opening formed therein for receiving breathing mixture under pressure which is directed through said valve body to said passageways in said exhaust port, and a valve closure member biased by a spring to close off said valve opening; and (f) means responsive to pressure in said breathing chamber for switching said exhalation assist valve open when the pressure in said breathing chamber is above ambient, whereby exhalation by the diver will increase the pressure of the breathing chamber above ambient and result in breathing mixture under pressure being directed to said exhaust port to assist exhalation, said means responsive to pressure in said breathing chamber comprising a flexible diaphragm mounted across a cavity formed in said case which is in communication with said breathing chamber, said flexible diaphragm being mounted to said valve closure member of said exhalation assist valve such that pressure above ambient in said breathing chamber will cause said flexible diaphragm to force said valve closure member away from said valve opening against the force of said spring biasing the same closed.

13. The regulator of claim 12 wherein said means responsive to pressure in said breathing chamber includes a flexible diaphragm secured within said case and having a surface thereof facing on said breathing chamber, and a mechanical linkage extending between said diaphragm and said main supply valve which is operable to open said valve when said diaphragm is drawn inwardly into said breathing chamber.

14. The regulator of claim 13 wherein said means responsive to pressure for switching said exhalation assist valve open comprises a mechanical linkage extending between said flexible diaphragm and said exhalation assist valve which is operable to open said exhalation assist valve when said diaphragm is pushed outwardly from said breathing chamber.

15. The regulator of claim 12 wherein the walls of said exhaust port define a venturi shape and wherein said passageways in said exhaust port direct breathing mixture outwardly from the throat of the venturi shaped exhaust port walls.

* * * * *

UNITED STATES PATENT AND TRADEMARK OFFICE

CERTIFICATE OF CORRECTION

PATENT NO. : 4,289,126

DATED : September 15, 1981

INVENTOR(S) : Ali A. Seireg; Amr M.S. Baz

It is certified that error appears in the above-identified patent and that said Letters Patent are hereby corrected as shown below:

Col. 10., line 12 insert "control" after second;

Col. 10, line 21 insert "than" after lower.

Signed and Sealed this

*Twelfth* Day of *January 1982*

[SEAL]

*Attest:*

GERALD J. MOSSINGHOFF

*Attesting Officer* *Commissioner of Patents and Trademarks*